United States Patent [19]

Bertram

[11] Patent Number: 4,519,874

[45] Date of Patent: May 28, 1985

[54] PROCESS FOR RECOVERING CARBONACEOUS AND SULFUR-CONTAINING PARTICLES FROM A RETORT

[75] Inventor: Rick V. Bertram, Yorba Linda, Calif.

[73] Assignee: Union Oil Company of California, Los Angeles, Calif.

[21] Appl. No.: 484,982

[22] Filed: Apr. 14, 1983

[51] Int. Cl.[3] ..... C10B 33/00; C10B 39/04; C10G 1/00

[52] U.S. Cl. ..... 201/39; 201/41; 208/8 R; 208/11 R

[58] Field of Search ..... 201/1, 32, 34, 35, 39, 201/41; 202/227; 208/8 R, 11 R

[56] References Cited

U.S. PATENT DOCUMENTS

| | | | |
|---|---|---|---|
| 2,783,898 | 3/1957 | Ardern et al. . | |
| 2,816,823 | 12/1957 | Galusha | 202/227 |
| 2,966,446 | 12/1960 | Deering . | |
| 3,004,898 | 10/1961 | Deering . | |
| 3,361,644 | 1/1968 | Deering . | |
| 3,476,650 | 11/1969 | Peacock | 201/39 |
| 4,003,797 | 1/1977 | Cheadle et al. . | |
| 4,004,982 | 1/1977 | Jennings et al. . | |
| 4,010,092 | 3/1977 | Deering . | |
| 4,083,770 | 4/1978 | Deering . | |
| 4,100,034 | 7/1978 | Smith et al. | 201/39 |
| 4,273,617 | 6/1981 | Goedde et al. . | |
| 4,288,294 | 9/1981 | Velling . | |
| 4,435,271 | 3/1984 | Deering et al. . | |
| 4,446,001 | 5/1984 | Deering et al. . | |
| 4,448,668 | 5/1984 | Deering . | |

OTHER PUBLICATIONS

"Premium Syncrude from Oil Shale Using Union Oil Technology" by Miller, Harvey and Hunter, prepared for the 1982 National Petroleum Refiners Association Annual Meeting held Mar. 21 to 23, 1982, at San Antonio, Tex.

"Synthetic Crude Oil and Transportation Fuels from Oil Shale" by Randle and Kelley, prepared for the 46th Midyear Meeting of the American Petroleum Institute's Refining Department, held May 11 to 14, 1981 in Chicago, Ill.

*Primary Examiner*—Bradley Garris

*Attorney, Agent, or Firm*—June M. Bostich; Gregory F. Wirzbicki; Dean Sandford

[57] ABSTRACT

A sealing system primarily for use with a superatmospheric upflow oil shale retort is comprised of a first and second vertical vessel, with a first sealing screw being employed to transport the particles as a continuous bed from the first to the second vessel, and with a second sealing screw to transport the particles from the second vessel to discharge. In the first vessel, shale particles are cooled by contact with water, which usually generates noxious gases, such as hydrogen sulfide. These noxious gases are removed from the sealing system by the purging action of two sealing gas streams, the first sealing gas removing the bulk of the noxious gases from the first vessel, and the second sealing gas removing residual noxious gases from the second vessel.

The shale particles are discharged to the environment from the second sealing screw in a dry condition, with a minimum emission of noxious gases. Also, due to the substantial pressure drop resistance offered by the continuous particle bed transported in the sealing screws, the particles are depressurized from the superatmospheric pressure of the retort and discharged under essentially atmospheric conditions.

18 Claims, 3 Drawing Figures

PROCESS FOR RECOVERING CARBONACEOUS AND SULFUR-CONTAINING PARTICLES FROM A RETORT

BACKGROUND OF THE INVENTION

This invention relates to retorting processes for recovering product hydrocarbons from oil shale and other hydrocarbon-bearing solids. More specifically, this invention relates to the cooling and depressurizing of retorted oil shale particles removed from an oil shale retort operated at superatmospheric pressure without loss of retort product gases and without substantial emissions of noxious gases.

Many methods for recovering oil from oil shale have been proposed, nearly all of which utilize some method of pyrolytic eduction commonly known as retorting. It is known to retort oil shale by a technique of contacting upflowing oil-bearing solids with downflowing gases in a vertical retort, and one such technique is disclosed in U.S. Pat. No. 3,361,644. To educe product vapors, the upward-moving bed of shale particles exchanges heat with a downflowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

To minimize the volume of the recycle gas required, upflow retorting is usually conducted with superatmospheric pressures, with the pressure in the upper regions of the retort often being between 10 and 30 p.s.i.g. However, means must be provided for introducing and recovering granular shale from the superatmospheric retorting zone without allowing valuable product and recycle gases to depressure. Conventional methods for achieving these objectives use elaborate lock vessels, valves, star feeders, or slide valves, which tend to wear rapidly and produce excessive fines through abrading the shale. Alternatively liquid sealing devices, as in U.S. Pat. No. 4,004,982, have been employed, which operate by moving shale particles through a standing head of oil or water, thereby creating a positive back pressure to forestall escape of retort gases. Liquid seals effectively contain retort gases but leave the shale saturated. Saturated shale causes operating problems resulting from weakened particle strength.

Conventional methods for cooling the retorted oil shale particles have also proven to be less than satisfactory. Such methods usually involve quenching the particles with water, a technique which leaves the shale undesirably liquidsaturated and consumes large quantities of water.

While the aforementioned features have met with some success, the need exists for further developments in shale retorting processes. For example, the need exists for a process by which retorted shale can be removed from a retort operating at superatmospheric pressure without loss of retort gases and be delivered in a cooled, dry condition suitable for disposal as landfill without excessive use of water or unacceptable pollution to the environment.

Accordingly, the principal object of this invention is to provide an easily installable apparatus of moderate height and a process for its use in removing retorted shale particles of relatively high sulfur content from a super-atmospheric oil shale retort while preventing loss of gases therefrom, partially cooling the shale, and avoiding unacceptable levels of environmental pollution.

It is an additional object to provide an alternative embodiment of this invention for use in localities where emissions of environmental pollutants are unregulated or for use with retorted particles of relatively low sulfur content.

It is another object of the invention to provide an apparatus and process for depressurizing and cooling retorted shale particles without using excessive quantities of water.

It is a further object of this invention to provide an apparatus and process for recovering retorted shale particles from an oil shale retort in an essentially dry condition.

SUMMARY OF THE INVENTION

The present invention provides an apparatus and method for its use in removing retorted particles containing carbonaceous components and sulfur components from a retort, especially from a retort operating at superatmospheric pressure, with substantially no loss of retort gases while delivering the particles in a cooled, essentially dry condition to a location at a lower pressure and emitting to the atmosphere only a minor portion of the noxious gases produced during cooling and transport of the shale. The sealing apparatus is comprised of a first and second vertical vessel, with a first sealing screw inclined therebetween to transport the particles as a continuous bed from the first to the second vessel and with a second inclined sealing screw to transport the particles from the second vessel to discharge.

In one embodiment of the invention, the first sealing vessel contains a cooling chamber and a gas disengaging chamber, and the second sealing vessel contains a surge chamber and a gas injection chamber. In operation, retorted shale particles or the like are passed from a retort into the cooling chamber wherein water, introduced to cool the particles, yields steam as well as gaseous products from the retorted particles. The bulk of the steam and gaseous products is removed from the first sealing vessel via the gas disengagement chamber, with the remaining portion traveling co-currently with the shale through the first sealing screw to the second sealing vessel. In the second sealing vessel, a sealing gas injected into the gas injection chamber divides; one portion travels counter-currently to the moving shale to exit from the surge chamber in admixture with the gases from the first sealing screw, while the remaining portion travels co-currently with the shale particles from the gas injection chamber of the second sealing vessel through the second sealing screw to discharge.

In the preferred embodiment, the invention further provides for a gas injection chamber within the first sealing vessel, so that both the first and second sealing vessels contain a gas injection chamber into which sealing gas is injected. In the first sealing vessel, one portion of the sealing gas sweeps essentially all the steam and gaseous products produced by contact with water in the cooling zone out of the first sealing vessel via the gas disengagement chamber. The remaining portion travels with the shale particles into the second sealing vessel where one portion of a second sealing gas sweeps gases from the first sealing screw out of the surge chamber and another portion travels through the second sealing screw with the shale particles to discharge.

In all embodiments of the invention, the amount of hydrogen sulfide and other gases discharged with the retorted shale particles from the second sealing screw is relatively low, with the preferred embodiment being most effective in this regard due to the use of separate sealing gas streams in each of the sealing vessels. In addition, the shale is recovered in a relatively cool and depressurized condition, the two sealing screws offering pressure drop resistance sufficient to recover the retorted shale from the second sealing screw at essentially atmospheric pressure despite a higher operating pressure in the retort.

BRIEF DESCRIPTION OF THE DRAWING

It will be noted that in FIG. 1 the incline from the horizontal of conduits 10 and 14 and the convergence and divergence from the vertical of the truncated cones making up the walls of sealing vessels 6 and 12 are, for convenience, shown at exaggerated angles differing from the description hereinafter of the drawing. In FIGS. 2 and 3, however, these angles are shown in conformity with the preferred embodiment of the invention, as set forth hereinafter in the specification.

DETAILED DESCRIPTION OF THE INVENTION

Figure 1:
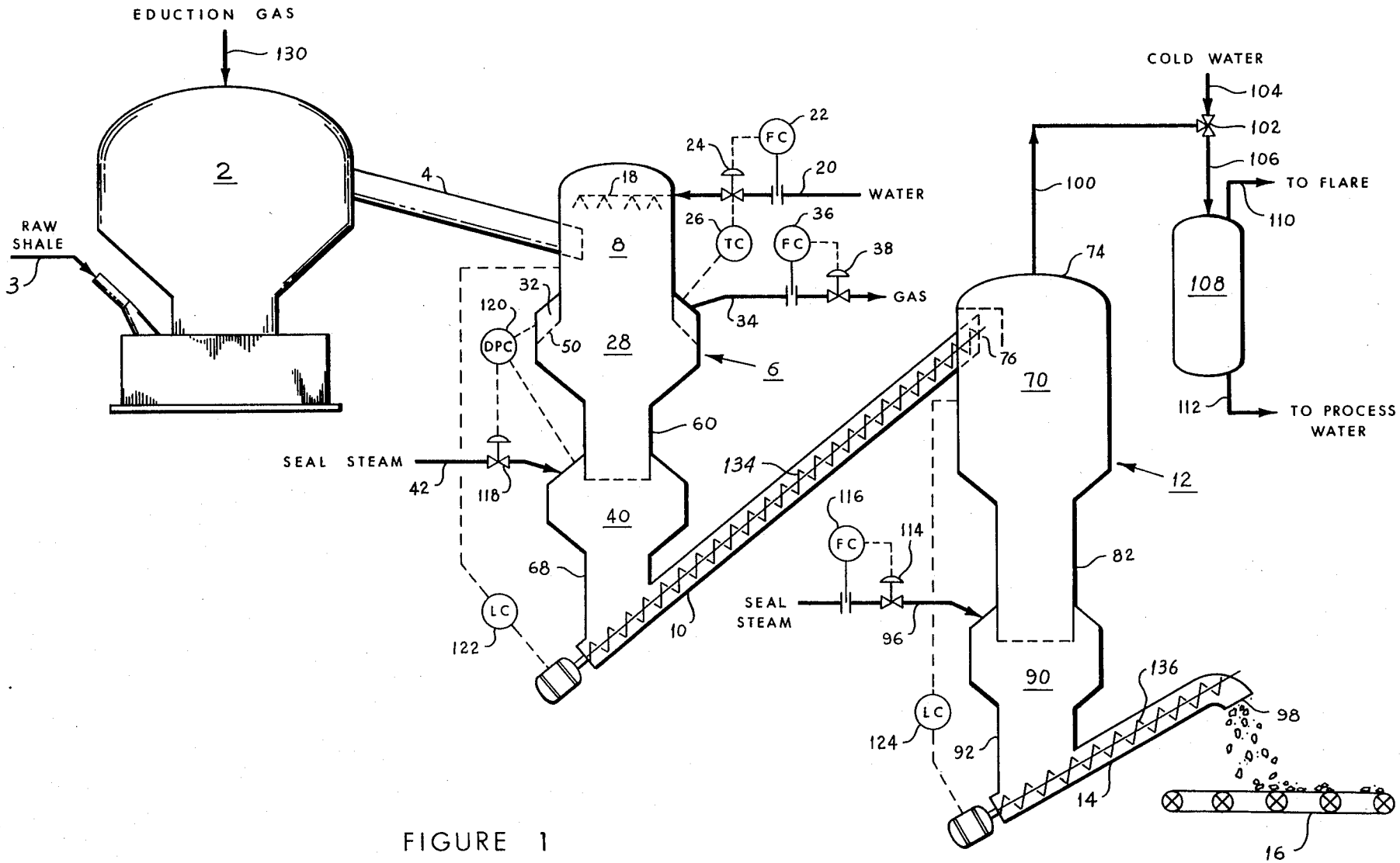
In FIG. 1 is shown a process flowsheet of the process of the invention, including the preferred embodiment thereof.

The preferred embodiment of the invention shown in FIG. 1 of the drawing includes a sealing system comprised of a first elongated fluid-tight vessel shown generally at 6, a first inclined sealing screw 134, a second elongated fluid-tight vessel shown generally at 12, and a second inclined sealing screw 136. Generally, the function of the sealing system is to receive, partially cool, and depressurize shale recovered from a conventional upflow retort, such as that disclosed in U.S. Pat. No. 3,361,644, without excessive discharge of noxious gases and without loss of product gases from the retort. In accordance with these objectives, retorted shale particles from retort 2 are recovered in vessel 6 and then passed to vessel 12 by means of inclined sealing screw 134. After traversing vessel 12, the shale particles are discharged by sealing screw 136. The shale is cooled in vessel 6 by introduction of liquid water, and since this may result in the formation of noxious gases, such as hydrogen sulfide, sealing gases are introduced via conduits 42 and 96 to sweep the noxious gases out of vessels 6 and 12 via conduits 34 and 100, respectively. These sealing gases further function to prevent loss of retort gases from the retort, which function is aided by the sealing screws, as the screws not only provide essentially all the pressure drop resistance to the flow of gas between retort 2 and the discharge of conduit 14 but also serve to depressurize the retorted shale particles from superatmospheric pressure at the entrance of vessel 6 to essentially atmospheric pressure at the point of discharge from conduit 14.

Figure 2:
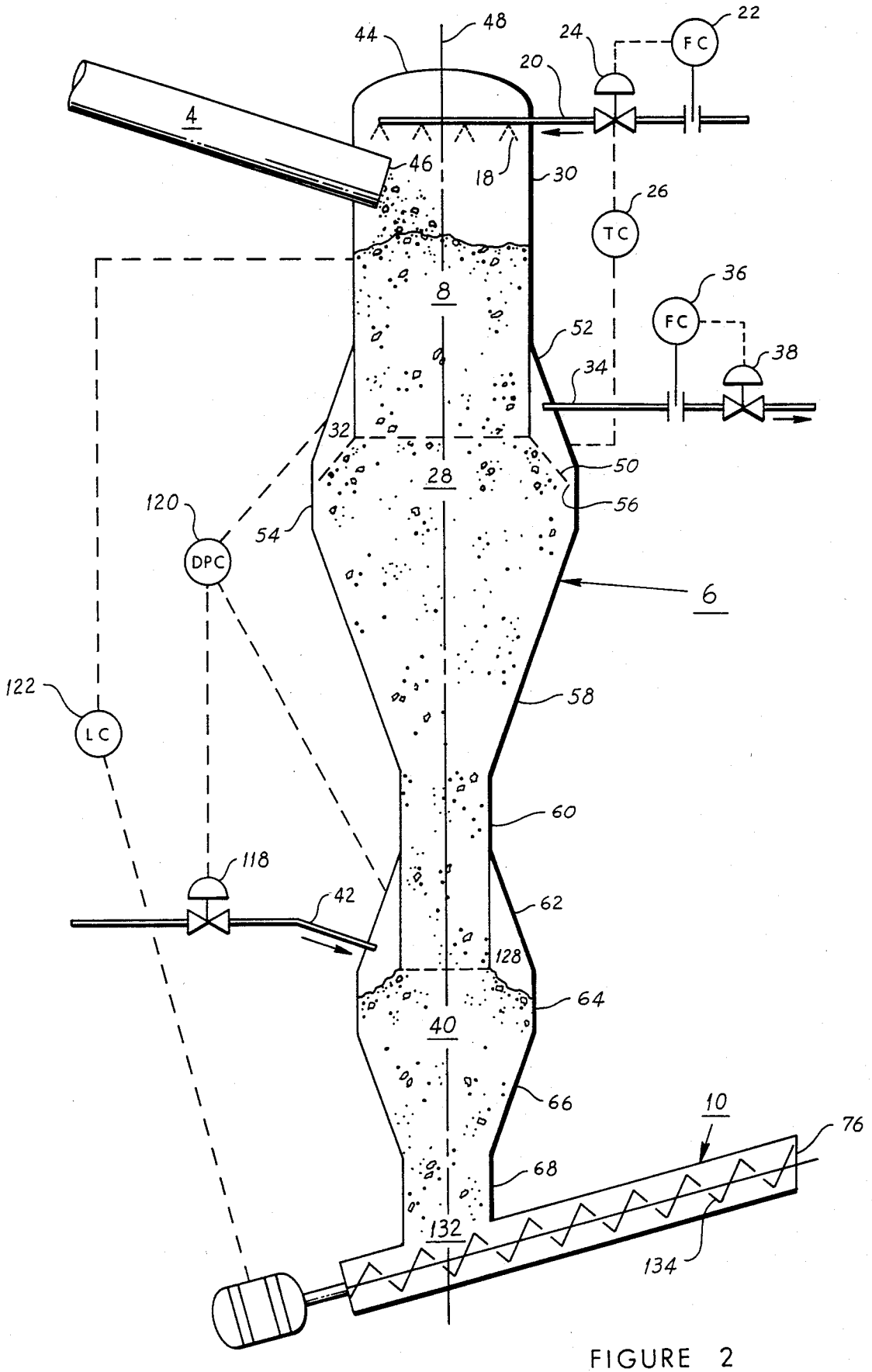
In FIG. 2 is shown the preferred embodiment of the first sealing vessel apparatus identified generally in FIG. 1 by reference numeral 6.

First sealing vessel 6, which is adapted to receive, pass, and discharge a gravitating bed of shale oil particles recovered from oil shale retort 2, will now be described in detail with respect to FIG. 2. The uppermost portion of vessel 6 contains cooling chamber 8, which is comprised of vertical first cylinder 30 enclosed at the top in a fluid-tight jointure with cooling chamber roof 44. Vessel 6 is adapted to receive a moving particle bed gravitating from retort 2 through conduit 4, which conduit extends into cylinder 30 and terminates at opening 46 within cooling chamber 8 near center axis 48. Cylinder 30 is sufficiently long to provide a desired residence time in the cooling chamber for the gravitating particle bed, typically between about 5 and about 30 minutes and preferably between about 8 and about 15 minutes. Cylinder 30 has a sufficiently large diameter in relationship to its height that, when traversed by the gravitating particle bed, little resistance to gas flow is created. Preferably, the walls of cylinder 30 are modified to taper inwardly from top to bottom to relieve some of the solids pressure created within the lower strata of the particle bed. An angle of taper between about 1 degree and about 5 degrees with respect to the vertical is typical, an angle between about 1.5 degrees and about 3 degrees is usual, and an angle of about 2 degrees is preferred.

Affixed within cooling chamber 8, preferably at a location above opening 46, is water distribution device 18, which is adapted to contact the gravitating particle bed with a variable but controlled flow of externally stored water from a source (not shown) via conduit 20. Associated with conduit 20 are flow controller 22, flow control valve 24, and temperature controller 26, which is in communication with gas collection chamber 32 hereinafter described.

Situated within vessel 6 immediately below cooling vessel 8 is gas disengaging chamber 28 adapted to remove gas from the gravitating particle bed. The preferred gas disengaging chamber includes a downwardly diverging truncated cone adapted with slots or other openings to allow the passage of gas while substantially preventing the passage of solids. Such a truncated cone is shown on the drawing as first truncated cone 50, the smaller end of which joins vertical cylinder 30 in a coaxial, fluid-tight bond in a plane wherein the cross-sectional diameters are equivalent. It is preferred that the slotted sides of first truncated cone 50 diverge at an angle just slightly steeper than that of the natural angle of repose of the moving particle bed, so that contact is always maintained between the bed and the slotted sides, thereby maintaining a stable gas disengaging particle surface. A diverging angle between about 20 degrees and about 40 degrees with respect to the vertical is preferable. The total void area available for gas to escape from the particle bed (in the preferred embodiment, the aggregate area of the slots in diverging truncated cone 50) is large enough to minimize the velocity of the escaping gas, thereby minimizing the quantity of fines entrainment. Escaping gas velocities through the slots of less than about 5 ft/sec are preferred, and velocities between about 2 and about 4 ft/sec are most preferred.

Outside the slotted walls of truncated cone 50 but within the exterior walls of vessel 6 is enclosed a gas collection chamber 32. Preferably, gas collection chamber 32 is a toroidal enclosure formed by first cylinder 30, first truncated cone 50, second vertical cylinder 54, and annulus covering ring 52. Communicating with gas collection chamber 32 is conduit 34, which is utilized to transfer gases from vessel 6 to facilities (not shown) for separation of condensable gases, noncondensable gases and entrained oil fines. Associated with conduit 34 is flow controller 36 and flow control valve 38.

Cylinder 54 is slightly larger in diameter than the largest diameter of truncated cone 50 so as to form annular opening 56 between truncated cone 50 and cylinder 54. Annular opening 56 prevents buildup of fines within gas collection chamber 32 by providing a passageway for fines to gravitate out of chamber 32 and back into the moving oil shale particle bed.

Annulus covering ring 52, in the form of a second truncated cone, is coaxially aligned along axis 48 with cylinder 54 and cylinder 30 and has a larger end and a smaller end. At its larger end, annulus covering ring 52 joins cylinder 54 coaxially in a fluid-tight bond. The smaller end has substantially the same diameter as the external diameter of vertical cylinder 30 and is coaxially and fluid-tightly mated thereto, diverging downwardly therefrom at any convenient angle.

The sides of cylinder 54 extend downwardly below first truncated cone 50 for a distance sufficiently long to assure that the particle bed gravitates along the entire underside of truncated cone 50, thereby continuing to maintain a stable gas disengaging particle surface within gas disengaging chamber 28. The larger end of downwardly converging third truncated cone 58 is affixed in a fluid-tight bond at a distance usually about 3 feet above the bottom opening thereof to the bottom of cylinder 54. The sides of truncated cone 58 converge at an angle of between about 15 and about 19 degrees, preferably at about 17 degrees with respect to the vertical. The smaller end of truncated cone 58 is attached in a coaxial fluid-tight bond to the upper end of third vertical cylinder 60. The diameter of cylinder 60 is, in the most preferred embodiment of the invention, the same as that of cylinder 68 to be described hereinafter, and the length of cylinder 60 is such as to extend a substantial distance into gas injection chamber 40.

Gas injection chamber 40, which is adapted for injection of gas into the body of the gravitating particle bed, is preferably comprised of fourth vertical cylinder 64 joined coaxially in fluid-tight fashion at its top to fourth truncated cone 62 and at its bottom to fifth truncated cone 66. Truncated cone 62 joins the exterior of cylinder 60 coaxially in fluid-tight arrangement and diverges downwardly therefrom at any convenient angle, connecting with cylinder 64 in a plane wherein the cross-sectional diameter of cone 62 is equal to that of cylinder 64. Downwardly converging truncated cone 66, on the other hand, converges at an angle of between about 15 and 20 degrees with respect to the vertical, and more preferably about 20 degrees, connecting coaxially in fluid-tight fashion with both cylinders 64 and 68 in planes wherein the cross-sectional diameters of the cylinders equal that of truncated cone 66.

Within gas injection chamber 40, void toroidal section 128 is formed by the outside of third cylinder 60, fourth truncated cone 62, fourth cylinder 64, and the face of the gravitating particle bed at its natural angle of repose, which particle bed in the preferred embodiment extends to and touches cylinder 64. In the preferred embodiment, the sides of cylinder 64 extend downward from their jointure with fourth truncated cone 62 for a distance sufficient to assure that the particle bed contacts the inside surface of cylinder 64. Gas injection chamber 40 is adapted to receive a stream of pressurized gas via conduit 42 into void toroidal section 128, the volume of which section is large enough for the pressurized gas to penetrate into the particle bed in a relatively even distribution.

Below gas injection chamber 40 is the entrance to first transfer conduit 10, said conduit being in fluid-tight communication between vessel 6 and vessel 12 and being adapted with means for receiving and transferring said particle bed therebetween while substantially reducing the gas pressure. Preferably, transfer conduit 10 contains a conventional sealing screw conveyor 134, and entrance 132 to conduit 10 is adapted to receive the particle bed discharged from cylinder 68 and transfer said particle bed into vessel 12. Further, conduit 10 is positioned to be inclined upwardly from the horizontal at an angle typically of between about 10 and about 20, and preferably about 15 degrees. Sealing screw 134 is typically about 5 to about 20 feet in length and preferably about 12 to about 15 feet in length, and over the run of its length rises vertically, typically about 1 foot to about 7 feet and preferably about 3 feet with respect to the location of entrance 132. Associated with the drive mechanism of sealing screw 134 and cylinder 30 of cooling chamber 8 is level control device 122. In addition, associated with void toroidal section 128 and gas collection chamber 32 is differential pressure controller 120, which is further associated with flow control valve 118 on conduit 42.

Figure 3:
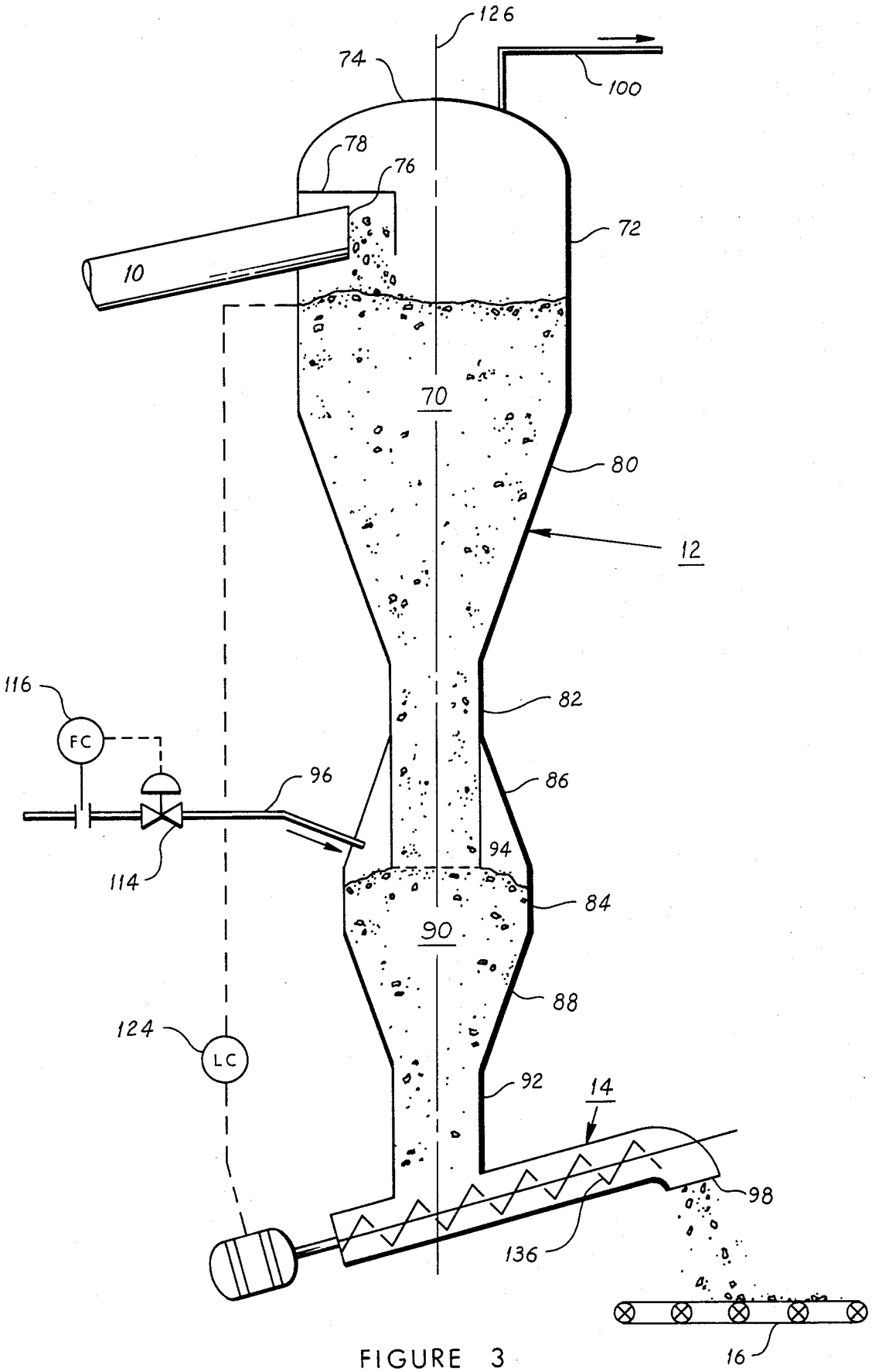
In FIG. 3 is shown the preferred embodiment of the second sealing vessel apparatus identified generally in FIG. 1 by reference numeral 12. All identical reference numerals in FIGS. 1, 2, and 3 refer to the same elements.

As shown in FIG. 3, conduit 10 is joined at the exit thereof to second sealing vessel 12, the uppermost portion of which contains surge chamber 70 comprised of sixth vertical cylinder 72 enclosed at the top in a fluid-tight jointure with surge chamber roof 74. Jointure of conduit 10 with the upper region of sixth vertical cylinder 72 forms opening 76 into surge chamber 70. At opening 76, the surge chamber is adapted to receive retorted shale particulates from the exit of conduit 10. Slightly above opening 76, shale deflector 78 is affixed to the inside surface of cylinder 72 and extends therefrom, preferably horizontally, to a distance typically less than the distance to the location of center axis 126 and deflects downwardly from that point at an angle of from about 90 to about 100 degrees, and preferably at about 90 degrees from the horizontal, to a location typically just above the bottommost point of opening 76. Cylinder 72 is sufficiently long to provide a desired residence time in the surge chamber for the gravitating particle bed, typically between about 2 and about 15 minutes.

Sixth truncated cone 80 is immediately below cylinder 72 joined thereto in a fluid-tight bond at its larger end and converging downwardly therefrom at any convenient angle. The smaller end of truncated cone 80 is of substantially the same diameter as seventh vertical cylinder 82, positioned immediately below truncated cone 80 and attached thereto coaxially in a fluid-tight bond. The diameter of cylinder 82 is, in the most preferred embodiment of the invention, the same as that of ninth vertical cylinder 92 to be described hereinafter, and the length of cylinder 82 is such as to extend a substantial distance into gas injection chamber 90.

Gas injection chamber 90, which is adapted for injection of gas into the body of the gravitating particle bed, is preferably comprised of eighth vertical cylinder 84 joined coaxially in fluid-tight fashion at its top to seventh truncated cone 86 and at its bottom to eighth truncated cone 88. Truncated cone 86 joins the exterior of cylinder 82 coaxially in fluid-tight arrangement and diverges downwardly therefrom at any convenient angle, connecting with cylinder 84 in a plane wherein the cross-sectional diameter of cone 86 is equal to that of cylinder 84. Downwardly converging truncated cone 88, on the other hand, converges at a preferred angle of between about 15 and 20 degrees with respect to the vertical, and more preferably about 20 degrees, connecting coaxially in fluid-tight fashion with both cylinders 84 and 92 in planes wherein the cross-sectional diameters of the cylinders equal those of truncated cone 88.

Within gas injection chamber 90, void toroidal section 94 is formed by the outside of cylinder 82, truncated cone 86, cylinder 84, and the face of the gravitating particle bed at its natural angle of repose, which in the preferred embodiment extends to and touches cylinder 84. In the preferred embodiment, the sides of cylinder 84 extend downward from their jointure with seventh truncated cone 86 for a distance at least sufficient to assure that the particle bed contacts the inside surface of cylinder 84. Gas injection chamber 90 is adapted to receive a stream of pressurized gas via conduit 96 into void toroidal section 94, the volume of which section is large enough for the pressurized gas to penetrate into the particle bed in a relatively even distribution.

Below gas injection chamber 90 is the entrance to second transfer conduit 14, which is affixed to vessel 12 in a fluid-tight bond and is adapted with means to receive and discharge said particle bed while substantially reducing the gas pressure thereon. In the preferred embodiment, transfer conduit 14 contains a conventional fluid-tight sealing screw 136, adapted to receive said particle bed discharged from cylinder 92 and transfer it for discharge at opening 98 to a solids removal device such as moving conveyor belt 16. Sealing screw 136 is inclined upward from the horizontal at an angle of typically between 10 and 20 degrees, and preferably about 15 degrees, and is typically about 5 to about 20 feet in length, and preferably about 12 to about 15 feet in length, and over the run of its length rises vertically typically between about 1 and about 7 feet, and preferably about 3 feet with respect to the location of the entrance thereto.

Associated with vessel 12 is level control device 124 joined to cylinder 72 and to the drive mechanism of sealing screw 136. Also associated with vessel 12 is flow control valve 114 joined to conduit 96 and responsive to flow controller 116.

Now most particularly with respect to FIG. 1, the sealing apparatus described with respect to FIGS. 2 and 3 will be described in operation. Retort 2, a conventional vertical upflow retort, is fed raw shale via conduit 3. Upward moving shale particles are contacted with hot downflowing eduction gases from conduit 130 to educe product vapors. Retorted shale particles, typically not more than 6 inches in mean diameter and usually ranging in size between about zero (as a fine dust) and about 2 inches mean diameter, at an elevated temperature, e.g., between about 900° and 1000° F., are removed from the upper portion of retort 2 where the prevailing pressure is generally superatmospheric, as for example at pressures between about 10 and 30 p.s.i.g., preferably 15 p.s.i.g. The shale particles are withdrawn from retort 2 by gravity flow through conduit 4, transported through a sealing system successively comprising first sealing vessel 6, first inclined sealing screw 134 within conduit 10, second sealing vessel 12, and second inclined sealing screw 136 within conduit 14, and then deposited onto conveyor 16 or other suitable means for transport of particulate solids to a disposal site. In FIG. 1, only one such sealing system is shown, but in actual practice, two or more sealing systems may be employed, operating in parallel. In the usual instance, between one and five sealing systems are employed, and in the preferred embodiment, two are employed.

More particularly in operation, after retorting, shale particles containing typically between about 0.4 and 0.6 weight percent of sulfur are passed through conduit 4 and form a gravitating particle bed in cooling chamber 8 within first sealing vessel 6. Ideally, no gases flow either way through conduit 4. In usual operation, however, a trickle of gases flows from retort 2 through conduit 4, together with the retorted shale particles. These gases are subsequently recovered from vessel 6 via gas collection chamber 32 and conduit 34 and recycled to retort 2 as make-up eduction gas via conduit 130 along with other noncondensable gases removed from vessel 6.

Cooling water is distributed evenly over the bed by water distribution device 18 fed with water via conduit 20. Typically, the rate of flow of the cooling water in conduit 20 is between about 87,600 and 189,800 pounds per 12,800 tons per day of shale, and preferably about 146,000 pounds per 12,800 tons per day of shale passed through conduit 4. In cooling chamber 8, the water flashes to steam, reducing the temperature of the retorted shale particles, preferably to between about 10° and about 100° F. above the dew point of water at the pressure prevailing within cooling chamber 8. The temperature of the partially cooled shale is maintained sufficiently high to assure that essentially all the water is flashed to steam, leaving the shale in a dry condition and thereby avoiding the potential problems caused by excessive wetting of the shale particles. The temperature of the shale particles is typically controlled by varying the flow of cooling water to cooling chamber 8 by the operation of flow controller 22 upon flow control valve 24 in response to temperature controller 26, which indirectly measures the temperature of the bed by measuring the temperature of disengaged gases in gas collection chamber 32. In an alternative embodiment, the temperature of the bed can be measured directly using temperature probes within the gravitating particle bed.

In the preferred embodiment, steam produced by the distribution of cooling water upon the hot shale particles flows downwardly through the co-currently flowing particle bed contained within cooling chamber 8, stripping hydrocarbonaceous gases therefrom and reacting therewith to form gases such as hydrogen and hydrogen sulfide. These gases commingle with the produced steam and the trickle of gases from retort 2 and flow into gas disengaging chamber 28 wherein the bulk of the commingled gases is removed from vessel 6 via conduit 34 after separating from the gravitating particle bed by flowing through slotted truncated cone 50 into gas collection chamber 32. In the preferred embodiment, the produced steam and commingled gases including gases leaked from retort 2 through conduit 4 into cooling chamber 8 are removed from gas collection chamber 32 via conduit 34 and sent to condensing and solids removal equipment (not shown) where condensable gases and oil shale fines are separated from the noncondensable gases.

To seal the retort and facilitate removal of the produced steam and commingled gases from the gas disengaging chamber by forestalling downward flow of gases from gas disengaging chamber 28, a first sealing gas stream comprised of inert gas and/or steam is introduced via conduit 42 into the particle bed gravitating from gas disengaging chamber 28 into first gas injection chamber 40. Typically, the rate of the first sealing gas is between about 1,000 and about 6,000 pounds per hour, preferably between about 1,200 and about 1,500 pounds per hour, per 12,800 tons per day of retorted shale passed through conduit 4. The rate and pressure of the first sealing gas stream is controlled by flow control valve 118 responsive to differential pressure controller 120 to ensure that the pressure in gas collection chamber 32 is typically about 0.6 to about zero p.s.i.g. less than the pressure prevailing in the retort, and preferably about 0.1 p.s.i.g. less than the pressure in said retort, and that the pressure in first gas injection chamber 40 is typically about 0.6 to 0.05 p.s.i.g. more than the pressure in gas collection chamber 32, and preferably about 0.3 p.s.i.g. more than the pressure therein.

The first sealing gas stream flows into the void of toroidal section 128 via conduit 42, permeates the descending particle bed contained within gas injection chamber 40, filling the void spaces therein, and divides into two portions. The first portion ascends countercurrently to the descending shale and exerts sufficient positive pressure to enter gas disengaging chamber 28 and mix together with downwardly flowing produced steam and other commingled gases from cooling chamber 8. The mixed gases containing the first portion of the sealing gas (between about 5 and about 40 percent of the sealing gas introduced via conduit 42, preferably about 10 percent thereof) enter gas collection chamber 32 and exit therefrom via conduit 34 at a rate controlled by the operation of flow controller 36 upon flow control valve 38. The second portion of the first sealing gas stream (typically between about 60 and about 95 percent, preferably about 90 percent thereof) introduced into first gas injection chamber 40 via conduit 42 does not ascend into the gas disengaging chamber 28 but flows co-currently with the descending shale through cylinder 68 and is transported via conduit 10 into sealing vessel 12 along with the particle bed.

During transport from vessel 6 into vessel 12, the retorted particles are maintained as a continuous bed within fluid-tight transfer conduit 10 so that pressure on the particle bed is reduced by the resistance of the particle bed to flow of the second portion of the first sealing gas stream therethrough. In the preferred embodiment, the particle bed is transported from vessel 6 into vessel 12 by a conventional fluid-tight sealing screw 134 within conduit 10, which is inclined at an angle from the horizontal sufficient to maintain the particles as a continuous bed and thereby assure a desired pressure differential between the exit from vessel 6 and the entrance into vessel 12. The pressure on the particle bed at the exit from vessel 6 is just slightly below that prevailing in the upper portion of cooling chamber 8, typically between about 10 and about 50 p.s.i.g., preferably between about 13 and about 17 p.s.i.g., and most preferably about 14.6 p.s.i.g., and typically the pressure on the particle bed at the entrance into vessel 12 is between about 0.1 and about 2 p.s.i.g., preferably between about 0.5 and about 1.5 p.s.i.g., and most preferably about 1 p.s.i.g.

Preferably, the first sealing gas is steam, which, as it travels through the gravitating bed of particles, reacts with residual coke and sulfur components on the retorted shale particles to produce gases such as carbon monoxide, carbon dioxide, hydrogen, hydrocarbonaceous gases, and hydrogen sulfide in addition to those produced by cooling the shale. In this embodiment, therefore, the sealing gas, which divides into the upwardly and downwardly flowing streams described above, comprises hydrogen, hydrocarbonaceous gases, carbon monoxide, carbon dioxide, and hydrogen sulfide. The upwardly flowing stream commingles with the downwardly flowing mixture of retort gases, produced steam, and noxious gases generated by the reaction of cooling water with hot retorted shale in gas disengaging chamber 28, and the resulting gas stream is removed from vessel 6 via gas collection chamber 32 and conduit 34 so that the bulk of the noxious gases contained in this gas stream ultimately returns to the retort via conduit 130 among the uncondensable gases introduced as a make-up gas for the eduction gas stream. Eventually, these uncondensable gases are recovered from retort 2 along with product gases, which are treated for removal of hydrogen sulfide by conversion to sulfur.

Hydrogen sulfide and other noxious gases are also generated by contact of the downwardly flowing second portion of the first sealing gas with the particles in first gas injection chamber 40 and transfer conduit 10. These noxious gases, along with the second portion of the first sealing gas, pass through first inclined sealing screw 134 within conduit 10 along with the bed of shale particles into second sealing vessel 12, the purpose of which is to facilitate disposal of noxious gases passed through first inclined sealing screw 134.

Substantially all of the gases delivered via the screw conveyor in conduit 10 are removed to disposal via conduit 100 by the action of an upward-flowing portion of a second sealing gas stream comprising inert gas or, preferably, steam introduced into toroidal section 94 of second gas injection chamber 90 via conduit 96 at a rate and pressure at least sufficient to ensure a division of flow of said second sealing gas stream, with a portion flowing upwardly from said second gas injection chamber into said surge chamber and with a portion flowing downwardly from said gas injection chamber into second sealing screw 136. Typically, at least about 10 percent, usually about 10 to about 30 percent, and preferably about 20 percent by volume of the sealing gases introduced into second gas injection chamber 90 via conduit 96 ascends through the bed of retorted shale particles in countercurrent flow, exerting enough positive pressure at the gas-solids interface to separate from the particle bed and mingle with the noxious gases and the second portion of the first sealing gas stream. Together, these gases exit from the upper regions of surge chamber 70 via conduit 100. Cold water via conduit 104 and three-way valve 102 is introduced into conduit 100 to cool and partially condense the mingled gases; the resultant mixture, including condensed and uncondensed gases, flows into separation vessel 108 via conduit 106.

In vessel 108 the free, uncondensed gases separate from the liquid fraction, which contains condensed gases, water, and trace amounts of uncondensed gases in solution. From the upper regions of vessel 108, the uncondensed gases, which in the preferred embodiment contain the major portion of the noxious gases produced during passage through first gas injection chamber 40 and first sealing screw 134 in conduit 10 into surge chamber 70 as above described, are sent to flare via conduit 110. From the lower regions of vessel 108, water, containing condensed gases and absorbed and/or dissolved uncondensable gases, is sent via conduit 112 to a facility (not shown) for purification.

Meanwhile, a downward flowing portion of the second sealing gas stream (typically at least about 10 percent, usually about 70 to about 90 percent, preferably about 80 percent by volume of the gases introduced into second gas injection chamber 90 via conduit 96) travels in co-current flow with the retorted shale particles downwardly through cylinder 92 and is transported from vessel 12 to an external source, with discharge of relatively low levels of sulfur-containing gaseous components. During transport from vessel 12 to the atmosphere, pressure on this portion of the second sealing gas stream is reduced by resistance to gas flow through a continuous particle bed maintained within second fluid-tight transport conduit 14. In the preferred embodiment, this gas stream, along with the retorted particles, is removed from vessel 12 by a conventional fluid-tight sealing screw 136, which is inclined at an angle from the horizontal sufficient to maintain the particles as a continuous bed and thereby assure the desired pressure differential between the exit from vessel 12 and opening 98, through which the gas stream is released to the atmosphere. Typically, gas pressure at the exit from vessel 12 is between about 0.05 and about 1.95 p.s.i.g., preferably between about 0.3 and about 1.3 p.s.i.g., and most preferably about 1.0 p.s.i.g., while gas pressure at opening 98 is, of course, atmospheric. Typically, the gas stream discharged from transfer conduit 14 comprises no more than 10 percent of the hydrogen sulfide and other noxious gases produced in the sealing apparatus, preferably no more than 5 percent thereof, and most preferably less than about 1 percent.

The rate of flow of the second sealing gas stream is controlled by flow control valve 114 operating in response to flow controller 116 so as to maintain the pressure in second gas injection chamber 90 slightly higher (typically about 0.05 to about 0.5 p.s.i.g. higher and preferably about 0.1 p.s.i.g. higher) than the pressure at opening 76 into surge vessel 70 and that at the exit of vessel 12, i.e., at the jointure of cylinder 92 and conduit 14. Typically, the flow rate of the second sealing gas stream is between about 100 and about 500 pounds per hour, preferably between about 280 and about 320 pounds per hour per 12,800 tons per day of shale passed through conduit 4.

During operation, unpredictable conditions may arise which cause the pressure at the entrance to vessel 12 to substantially increase from the usual. For instance, a large void space may develop within the particle bed traversing the first transfer conduit 10, permitting gas to enter vessel 12 without pressure loss. Or, occasionally, a blockage of the particles gravitating through vessel 6 will form, allowing the particles below the blockage to empty from both vessel 6 and first transfer conduit 10, with the result that pressure in vessel 12 remains substantially the same as that prevailing in vessel 6. Such upset conditions would depressurize the retort except that in the present invention the automatic pressure regulating capacity of second transfer conduit 14 compensates for the loss of pressure reduction in transfer conduit 10. In such situations, the pressure drop in second transfer conduit 14 automatically increases, becoming up to about as great as that occurring in first transfer conduit 10 during normal operations. The second transfer conduit, therefore, functions as a back-up pressure regulator.

Movement of the retorted particles is regulated to facilitate the cooling, sealing, and pressure reduction functions of the sealing system. Particles removed from the retort are passed as an essentially continuous bed serially through first sealing vessel 6 and first inclined sealing screw 134 within conduit 10 and thereafter through second sealing vessel 12 and second inclined sealing screw 136 within conduit 14. To assist in maintaining a continuous bed of particles throughout sealing vessel 6 and conduit 10 as well as to regulate the residence time of shale particles therein, level control device 122 attached to cylinder 30 of cooling chamber 8 and to the drive mechanism of first sealing screw 134 adjusts the rate at which shale particles are removed from first sealing vessel 6 and delivered into first inclined sealing screw 134. During passage through conduit 10 by sealing screw 134, the retorted shale particles are partially crushed to decrease the void space therein and the gas pressure thereon is substantially reduced by the resistance to gas flow presented by the particle bed as above described. The upwardly inclined angle of conduit 10 facilitates transport of a continuous particle bed and thereby minimizes formation in the bed of large void spaces through which gases can depressure uncontrollably. In like manner, to regulate the rate at which shale particles are removed from conduit 14 by second sealing screw 136 and to assure a continuous bed of shale throughout second sealing vessel 12 and second sealing screw 136, conduit 14 is upwardly inclined from the horizontal and the drive mechanism of second sealing screw 136 is responsive to level control device 124 attached to cylinder 72 of sealing vessel 12.

In a first alternative embodiment of the invention, the apparatus can be used temporarily for processing particles containing relatively small amounts of sulfur-containing components, such as 0.2 to 0.3 weight percent of retorted shale, by temporarily modifying vessel 6 to use the steam generated in cooling the particles to seal the retort. In this embodiment, flow control valve 118 is closed and the operation of differential pressure controller 120 is overridden so that the particle bed gravitates through gas injection chamber 40 without being injected with a stream of sealing gas.

In the operation of this alternative embodiment, the steam produced by distribution of cooling water upon the hot shale particles in cooling chamber 8 commingles with gases stripped from the particles or generated by reaction of the particles with steam, including any hydrogen sulfide, and with a trickle of gases flowing from retort 2 into cooling chamber 8 through conduit 4. The resulting gases exert sufficient positive pressure in the upper regions of cooling chamber 8 to substantially forestall escape of significant amounts of gases from retort 2 while generally flowing downwardly with the cocurrently moving particle bed contained within cooling chamber 8 and into gas disengaging chamber 28 wherein they divide into two portions. A major portion, typically about 90 to about 99 percent of the commingled gases, is removed from vessel 6 via conduit 34 by separating from the gravitating particle bed and flowing through slotted truncated cone 50 into gas collection chamber 32. However, the minor portion of the commingled gases, typically about 1 to about 10 percent thereof, flows downwardly through the gravitating particle bed, passes through cylinder 60, gas injection chamber 40 and cylinder 68; traverses transfer conduit 10 containing first inclined sealing screw 134 along with the particle bed; and therein encounters sufficient pressure drop resistance to maintain a pressure throughout sealing vessel 6 as necessary to contain product gases within the retort. Typically, the pressure of the second portion of the commingled gases at the entrance into first inclined sealing screw 134 is between about 10 and about 30 p.s.i.g., and preferably about 14.6 p.s.i.g. After traversing screw 134, the second portion of the commingled gases has typically been reduced in pressure to between about 0.5 and about 1.5 p.s.i.g., and preferably to about 1.0 p.s.i.g.

From transfer conduit 10 the retorted particles and gases pass together into second sealing vessel 12 and proceed therethrough in substantially similar manner as is described above for the preferred embodiment of this invention. However, compared to the preferred embodiment, and assuming comparable proportions of sulfur in the retorted shale, the amount of hydrogen sulfide discharged from vessel 12 via conduit 100 and emitted to the atmosphere at opening 98 will be increased in this embodiment over that of the preferred embodiment. Thus, the present embodiment is of most usefulness when low proportions of sulfur are contained in the retorted shale or where environmental regulations controlling emissions of hydrogen sulfide are lax.

In another alternative embodiment of the invention for use in localities where environmental regulations governing emissions of noxious atmospheric pollutants such as hydrogen sulfide are relatively lax or for retorting particles bearing relatively small proportions (e.g., 0.2 to 0.3 weight percent) of sulfur capable of generating hydrogen sulfide under process conditions herein, the sealing apparatus is modified to omit gas injection chamber 40. Also omitted are conduit 42 leading thereinto, differential pressure controller 120, flow control valve 118, and cylinder 68, which in the preferred embodiment, joins gas injection chamber 40 to first inclined sealing screw 134. In this alternative embodiment, the entrance to screw 134 is adapted to receive the particle bed discharged from cylinder 60 in the same manner as described hereinabove with respect to cylinder 68 in the preferred embodiment. In this configuration, movement of retorted particles and flow of gases are substantially the same as described above with respect to the first alternative embodiment, except that from gas disengaging chamber 28 and cylinder 60 the major portion of the commingled gases flows with the particle bed directly into transfer conduit 10.

The apparatus of the sealing system and the method of its use as above described offer several advantages, among which is a shale cooling and pressure reducing apparatus of moderate height, the height being somewhat regulated by adjusting the length and angle of upward inclination from the horizontal of each of the transfer conduits. Preferably, the sealing system is housed in two vertically aligned sealing vessels connected by an inclined sealing screw, and can be positioned to receive gravitating particles from a retort without necessitating extensive excavation.

This invention offers the further advantage of an apparatus and a process typically used with retorted particles of high sulfur content, but readily convertible for use in remote localities where emissions of noxious gases are not closely regulated or with particles of low sulfur content, at great savings in energy and water. In the modified process, steam generated by cooling the retorted particles substitutes as the sealing gas in the first sealing vessel, thereby completely eliminating the steam requirement for the first sealing vessel and cutting the overall steam requirements for the process by as much as 80 percent.

This invention offers the principal advantage of a sealing apparatus and method for its use for removing shale particles bearing hydrocarbonaceous and sulfur-containing components from a superatmospheric retort and discharging them in a cooled, dry condition while preventing escape to the atmosphere of retort gases or unacceptable levels of hydrogen sulfide and other noxious gases generated within the sealing apparatus. The steam-injected sealing vessels placed at the entrance to each of two sequential inclined sealing screws facilitate safe disposal of at least 90 percent, preferably as much as 99 percent, by volume of the hydrogen sulfide and other noxious gases generated within the sealing apparatus. The first sealing vessel also facilitates collection for use as make-up eduction gas of any uncondensable gases that leak from the retort.

An additional advantage offered by this invention is its minimal requirements for cooling water.

A further advantage offered by the present invention resides in the fact that the bulk of the pressure reduction occurring between conduit 4 and opening 98 of conduit 14 is achieved by the two sealing screws. In typical operation, wherein the void spaces in both screws is minimized, the two screws are responsible for at least 90 percent, preferably at least 95 percent, of the pressure drop resistance between conduit 4 and opening 98. In addition, the first sealing screw 134 is itself usually responsible for at least 80 percent, preferably at least 85 percent, and more preferably still at least 90 percent of the pressure drop resistance between conduit 4 and opening 98.

Although this invention has been described in conjunction with a preferred embodiment thereof, it is evident that many alternatives, modifications, and variations will be apparent to those skilled in the art in light of the foregoing description. For example, a variety of hydrocarbon-bearing or carbonaceous particulates may be used in the process of the invention, including coal and lignite. Accordingly, it is intended to embrace these and all such alternatives, modifications, and variations that fall within the spirit and scope of the appended claims.

I claim:

1. A process for depressurizing retorted particles removed from a retort, said process comprising:

(1) removing said particles containing carbonaceous components and sulfur components from the retort and passing them as a particle bed through a cooling zone;

(2) cooling the particles with water directed into said cooling zone so as to generate a produced gas comprising steam and hydrogen sulfide while cooling said particles;

(3) recovering a first portion of said produced gas generated in step (2) from a gas disengaging zone while said particles pass through said gas disengaging zone;

(4) transferring a second portion of said produced gas co-currently with said particles into a surge zone while undergoing accompanying substantial pressure drop, said particles during transfer being maintained as a continuous bed offering substantial pressure drop resistance;

(5) removing from a surge zone said second portion of the produced gas together with a commingled first portion of a sealing gas from step (6) while said particle bed passes from the surge zone into a gas injection zone;

(6) injecting sealing gas into the particles bed in said gas injection zone, said sealing gas dividing into at least a first and a second portion, the first portion passing countercurrently to the particles into said surge zone and commingling therein with the second portion of the produced gas, and the second portion passing co-currently with the particles out of the gas injection zone;

(7) transferring the particles and the second portion of the sealing gas from said gas injection zone to a location for discharge while undergoing a pressure drop, said particles during transfer being maintained as a continuous bed offering pressure drop resistance; and (8) discharging the particles and said second portion of the sealing gas.

2. The process defined in claim 1 wherein the gas pressure within said retort is greater than the gas pressure within said gas disengaging zone, the gas pressure in said gas disengaging zone is greater than the gas pressure in said surge zone, and the gas pressure within said surge zone is less than the gas pressure within said gas injection zone.

3. A process for depressurizing retorted oil shale particles removed from a retort, said process comprising:

(1) removing said particles containing carbonaceous components and sulfur components from a retorting zone at a temperature above about 600° F. and introducing them into a first sealing vessel wherein the retorted particles are passed as a particle bed serially through two zones, wherein:

(i) in the first zone the particles are partially cooled with water while generating commingled produced steam and gases including hydrogen sulfide;

(ii) in the second zone the commingled produced steam and gases from the first zone travel co-currently with the retorted particles and divide, a first stream thereof being removed from the second zone and a second stream passing therefrom co-currently with the retorted shale particles;

(2) transferring the retorted shale particles and the second stream of said commingled produced steam and gases recovered from said second zone of the first sealing vessel into a second sealing vessel while effecting a substantial pressure drop, said particles during transfer being maintained as a continuous bed offering pressure drop resistance;

(3) passing said particles together with said second stream of commingled produced steam and gases from step (2) into a second sealing vessel wherein said particles pass as a particle bed serially through two zones, wherein:

(i) in the first zone the second stream of the commingled produced steam and gases from the first sealing vessel is separated from the particles and removed, along with a first portion of a sealing gas stream, which enters the first zone from the second zone of the second vessel, said first portion of the sealing gas passing countercurrently through the particles;

(ii) in the second zone, sealing gas is introduced into the particles and divides into at least a first and a second portion, the first portion passing countercurrently to the particles into the first zone, and the second portion passing co-currently out of the second zone together with said particles;

(4) transferring said particles with the second portion of the sealing gas stream recovered from said second sealing vessel to a location for discharge while effecting a pressure drop, said particles during transfer being maintained as a continuous bed; and (5) discharging said particles and said second portion of the sealing gas containing a relatively small proportion of said hydrogen sulfide.

4. The process defined in claim 3, said process further comprising:

(6) flowing a stream of said produced steam and gases countercurrently to said particles into said retort.

5. The process defined in claim 3 wherein: (a) the sealing gas comprises steam, (b) a small portion of produced gases from the retort flows into said first zone of the first vessel together with the retorted particles, and (c) said particles range in size from about zero to about 2 inches in mean diameter.

6. The process defined in claim 3 wherein the sealing gas comprises inert gas.

7. The process defined in claim 3 wherein the gas pressure on the particle bed at the exit from the first vessel is between about 13 and about 17 p.s.i.g., the gas pressure at the entrance to the second vessel is between about 0.5 and about 1.5 p.s.i.g., the gas pressure on the particle bed at the exit from the second vessel is between about 0.5 and about 1.5 p.s.i.g., and the pressure at discharge of the particles is about atmospheric.

8. A process for depressurizing retorted particles of oil shale containing carbonaceous and sulfurous components removed from a retort operating at superatmospheric pressure, said process comprising:

(1) removing said particles from the retort and passing them as a gravitating particle bed through a cooling zone;

(2) cooling the particles with water directed into said cooling zone so as to generate a produced gas comprising steam and hydrogen sulfide while cooling said particles;

(3) recovering said produced gas generated in step (2) and a commingled first portion of a first sealing gas stream in a gas disengaging zone while said particles pass through said gas disengaging zone;

(4) injecting into said gravitating particle bed within a first gas injection zone a first sealing gas stream which divides, a first portion of said first sealing gas stream flowing upwardly through said particle bed and entering said gas disengaging zone and a second portion flowing downwardly in co-current flow with said particle bed;

(5) transferring said second portion of the first sealing gas stream from step (4) co-currently with said particles from said first gas injection zone into a surge zone while undergoing an accompanying substantial pressure drop, said particles being maintained during transfer as a continuous bed offering substantial pressure drop resistance;

(6) separating from said particle bed and removing from said surge zone said second portion of the first sealing gas stream from step (5) together with a commingled first portion of the second sealing gas stream from step (7) while said particle bed passes from the surge zone into a second gas injection zone;

(7) injecting a second sealing gas stream into the particle bed recovered from step (6) within a second gas injection zone, said second sealing gas stream dividing so that a first portion flows upwardly through said second gas injection zone and into said surge zone and a second portion flows downwardly out of said second gas injection zone;

(8) transferring the particles and the second portion of the second sealing gas stream from said second gas injection zone co-currently with said particles to a location for discharge while undergoing an accompanying pressure drop, said particles during transfer being maintained as a continuous bed offering pressure drop resistance; and (9) discharging said particles and said second portion of the second sealing gas stream containing a relatively small amount of hydrogen sulfide.

9. The process defined in claim 8 wherein said second portion of the second sealing gas stream comprises no more than 5 percent by volume of the hydrogen sulfide produced in the cooling zone.

10. The process defined in claim 8 wherein the temperature maintained in said cooling zone is between about 10° and about 100° F. above the dew point of water at the gas pressure prevailing within said cooling zone.

11. The process defined in claim 8 wherein the particles of shale passed out of said cooling zone are in a relatively dry condition.

12. The process defined in claim 8 wherein the gas pressure on the particle bed at the exit from the first gas injection zone is between about 13 and about 17 p.s.i.g., and the pressure at the entrance to the surge zone is between about 0.5 and about 1.5 p.s.i.g. and the gas pressure on the particle bed at the exit from the second gas injection zone is between about 0.5 and about 1.5 p.s.i.g. and the pressure at discharge of the particles is about atmospheric.

13. The process defined in claim 8 wherein: (a) said first and second sealing gas streams comprise steam, (b) a small portion of produced gases from said retort flows into said cooling zone together with said particles, and (c) said particles range in size from about zero to about 2 inches in mean diameter.

14. The process defined in claim 8 wherein said first and second sealing gas streams comprise inert gas.

15. The process defined in claim 8 wherein the gas pressure within said retort is greater than the gas pressure within said gas disengaging zone but less than the gas pressure in said first gas injection zone, the gas pressure in said first gas injection zone is greater than the gas pressure in said surge zone and said gas disengaging zone, and the gas pressure within said surge zone is less than the gas pressure within said second gas injection zone.

16. A process for depressurizing retorted particles containing carbonaceous and sulfurous components removed from an oil shale retort operating at superatmospheric pressure, said process comprising:

(1) removing said particles from a retorting zone at a temperature above about 600° F. and introducing them into a first sealing vessel wherein the retorted particles are passed as a gravitating particle bed serially through three substantially vertically aligned zones, wherein:

(i) in the first zone the particles are partially cooled with water while generating produced steam and gases including hydrogen sulfide, said produced steam and gases commingling with a trickle of gases passed therein from said retorting zone;

(ii) in the second zone the commingled produced steam and gases from the first zone, which travel co-currently with the retorted particles, is removed along with a commingled first portion of a first sealing gas stream from the third zone;

(iii) in the third zone a first stream of sealing gas is introduced into the particles and divides into at least a first and a second portion, the first portion passing countercurrently to the particles into the second zone, and the second portion passing co-currently with the particles out of the third zone together with said particles;

(2) transferring the retorted shale particles and the second portion of the first sealing gas stream recovered from said third zone of the first sealing vessel into a second sealing vessel while effecting a substantial pressure drop, said particles during transfer being maintained as a continuous bed offering substantial pressure drop resistance;

(3) passing said particles together with said second portion of the first sealing gas stream from step (2) into a second sealing vessel wherein said particles pass as a gravitating particles bed serially through two substantially vertically aligned zones, wherein:

(i) in the first zone the second portion of the first sealing gas stream from the first sealing vessel is separated from the particles and removed along with a first portion of a second sealing gas stream which enters the first zone from the second zone of the second vessel, said first portion of the second sealing gas passing countercurrently through said particles;

(ii) in the second zone, a second sealing gas stream is introduced into the particles and divides into at least a first and a second portion, the first portion passing countercurrently to the particles into the first zone and the second portion passing co-currently out of the second zone together with said particles;

(4) transferring said particles with the second portion of the second sealing gas stream recovered from said second sealing vessel to a location for discharge while effecting a substantial pressure drop, said particles during transfer being maintained as a continuous bed offering substantial pressure drop resistance; and (5) discharging said particles and said second portion of the second sealing gas stream which contains a relatively small proportion of hydrogen sulfide.

17. The process defined in claim 16 wherein said first and second sealing gas streams comprise inert gas.

18. The process defined in claim 16 wherein said first and second sealing gas streams comprise steam.

* * * * *